US006056393A

United States Patent [19]

Taneya et al.

[11] Patent Number: 6,056,393

[45] Date of Patent: May 2, 2000

[54] INK-JET RECORDING HEAD AND INK-JET CARTRIDGE

[75] Inventors: Yoichi Taneya, Yokohama; Taiji Yoshinari, Ninomiya-machi; Shinichi Miyauchi, Kawasaki; Masaru Iketani, Sagamihara; Masaaki Okada, Sanjyo, all of Japan

[73] Assignee: Canon Kabushiki Kaisha, Tokyo, Japan

[21] Appl. No.: 08/990,680

[22] Filed: Dec. 15, 1997

[30] Foreign Application Priority Data

Dec. 18, 1996 [JP] Japan ..... 8-338267
Dec. 3, 1997 [JP] Japan ..... 9-332997

[51] Int. Cl.[7] ..... B41J 2/175
[52] U.S. Cl. ..... 347/86
[58] Field of Search ..... 347/85, 20, 54, 347/56, 63, 86; 216/27; 29/890.1

[56] References Cited

U.S. PATENT DOCUMENTS 5,694,684 12/1997 Yamamoto ..... 29/890.1

FOREIGN PATENT DOCUMENTS 0 419 180 3/1991 European Pat. Off. .
0 495 670 7/1992 European Pat. Off. .
0 694 397 1/1996 European Pat. Off. .
0 695 642 2/1996 European Pat. Off. .
0 849 084 6/1998 European Pat. Off. .
3-101957 4/1991 Japan .
4-247946 9/1992 Japan .
4-250048 9/1992 Japan .
5-138896 6/1993 Japan .
8-142329 6/1996 Japan .

*Primary Examiner*—N. Le
*Assistant Examiner*—Anh T. N. Vo
*Attorney, Agent, or Firm*—Fitzpatrick, Cella, Harper & Scinto

[57] ABSTRACT

An ink-jet recording apparatus that reduces degradation phenomena in a recording dignity, such as a staggered flying trajectory of an ink droplet caused by poor adhesion between an ink path and a substrate. The ink-jet apparatus includes, a first contacting surface, which enables the ink paths to contact a substrate. The first contacting surface is positioned at an incline relative to a second contacting surface. When a trenched top board is mounted on the substrate, which is fixed on a base plate, only a protrudent ridge, which is formed on an ejector N side of the contacting surface, contacts the substrate. When a pressurizing force is applied from an elastic member through a pressurizing member onto a portion to be pressurized, the contacting surface contacts uniformly with the substrate due to a deformation of the trenched top board.

6 Claims, 4 Drawing Sheets

INK-JET RECORDING HEAD AND INK-JET CARTRIDGE

BACKGROUND OF THE INVENTION

1. Field of the Invention

The present invention relates to an ink-jet recording head and an ink-jet cartridge which are used for an ink-jet recording apparatus and, more particularly, to a bubble jet recording head and a bubble jet cartridge.

2. Brief Description of the Related Art

An ink-jet recording system, wherein minute droplets generated out of an ink are adhered to recording media such as a sheet of paper, is a sort of recording systems having characteristic properties such that noise generation during recording is extremely low, a high-speed recording is capable and a recording even onto a sheet of plain paper is allowable. Among the ink-jet recording systems, so called a "bubble jet" recording mode, which employs an exothermic device as an energy generating means for ejecting the ink droplets, has recently been attracting a particular attention.

As a method for manufacturing the ink-jet recording head in the bubble jet recording mode, a technology constituted below has been known, comprising steps of:

- arraying a plurality of ejecting energy generating means formed of such as exothermic devices for generating each of thermal energies used for ejecting an ink onto a substrate;
- fixing the substrate onto a base plate;
- providing a top board with trenches, each of which constitutes an ink path correspondent to each of the exothermic devices;
- providing the trenched top board also with each of ejecting ports formed correspondingly to each of the ink paths;
- providing the trenched top board still also with a concavity forming a common liquid reservoir connected to each of the ink paths;
- contacting the trenched top board with the substrate to fix the board on the substrate by an aid of a pressurizing member connected onto the base plate;
- assembling an ink supplying member for supplying the inks onto the trenched top board; and
- further filling an encapsulant such as a polymerized silicone plastic resin or the like between the trenched top board and the substrate for a purpose of preventing leakage of any liquids.

As one of the ink-jet heads constituted as mentioned above, a pressurizing member having a constitution to generate a piping line pressure, thereby to press approximately uniformly an area located on the top board, which corresponds to an ink path forming area provided adjacently to the ink ejecting ports of the trenched top board, has been disclosed in the Japanese Laid-open Patent Application Number: 3-101955 (1991). In the ink-jet heads constituted as aforesaid, it is desirable that a contacting part of the ink path area formed on the trenched top board to be contacted with the substrate adheres assuredly to the substrate.

Namely, if the contacting part of the ink path area formed on the trenched top board to be contacted with the substrate does not adhere assuredly to the substrate, the ejecting pressure generated by the exothermic devices during a recording operation is dispersed and spreaded to the adjacent ink paths. This phenomenon is liable to make an ink ejecting speed unstable, resulting in staggered flying trajectories of the ink droplets, and also liable to disturb normal meniscus positions in the adjacent ink paths except for that which should eject the ink, resulting in a turbulent printing. All of above-mentioned results degrade a recording quality.

Accordingly, another constitution, wherein a stepwise level difference is formed newly on the trenched top board so that the contacting area of the common liquid reservoirs to be contacted with the substrate turns lower compared with another contacting area of the ink path to be contacted with the substrate in order that the contacting area of the ink paths should contact assuredly with the substrate, has been further disclosed in the Japanese Laid-open Patent Application Number: 3-101957 (1991).

In the ink-jet head disclosed in the Japanese Laid-open Patent Application Number: 3-101957 (1991), however, only a bump-shaped projection, which is provided on a rear surface of the common liquid reservoirs, actually contacts with the substrate as the contacting area of the common liquid reservoirs to be contacted with the substrate. Consequently, the encapsulant, which should fill vacancies located between the substrate and the trenched top board, intrudes frequently through the vacancies, where the trenched top board does not contact with the substrate, into the liquid reservoirs. When the intruded encapsulant reaches the ink paths, it induces clogging failures of the paths. Accordingly, a still another constitution for preventing the encapsulant from intrusion, wherein a rib-shaped protrudent member provided only around the liquid reservoirs of the trenched top board is supplemented to the ink head constitution as disclosed in the Japanese Laid-open Patent Application Number: 3-101957 (1991), has been disclosed in a Japanese Laid-open Patent Application Number: 5-138896 (1993).

However, it requires a considerably high pressurizing force to deform the rib-shaped protrudent member provided around the liquid reservoirs though the ink head constitution disclosed in a Japanese Laid-open Patent Application Number: 5-138896 (1993) can actually prevent the encapsulant intrusion to a certain extent. Aforesaid high pressurizing force does not have so ill effect indeed so long as an array density of the ink paths on the trenched top board is low. If the array density exceeds 600 dpi, the force deforms even ink path walls because a wall thickness should be thinned due to the high array density. On the contrary, when the pressurizing force of the pressurizing member is set up to be low in order not to deform the ink path walls, the adhesion of the ink path area is worsened than so far because aforesaid protrudent member is formed higher than the contacting area of the ink path to be contacted with the substrate.

When the arraying density of the ink paths is densified, above-mentioned deformation in the ink path walls induced by the pressurizing force of the pressurizing members takes place even in the constitution without aforesaid protruded member provided on the trenched top board. Actually, when a high pressurizing force generated by the pressurizing member 6 is applied to a portion 5 to be pressurized which is mounted on the trenched top board shown in FIG. 5 for illustrating a longitudinally sectioned partial view of a conventional ink-jet recording head, a common liquid reservoir side of the ink paths 4 is deformed around a portion B, which serves as a supporting point, so that an ejecting port side N of the ink paths 4 formed on the trenched top board 1 floats from the substrate 2 because a rigidity of the common liquid reservoir side of the ink paths 4 cannot be enforced compared with the ejecting port side N. To float the ejecting port side N of the ink paths 4 formed on the trenched top board 1 from the substrate 2 has severer effects on the printing quality.

SUMMARY OF THE INVENTION

The present invention is carried out to solve the problems that the conventional technologies have encountered with as mentioned above. An object of the present invention is to enable the ink-jet recording head to maintain an excellent adhering status between the trenched top board and the substrate even when the ink paths are arrayed in a high density. Another object of the present invention is to enable the recording head to attain a strong adhesive status between the trenched top board and the substrate even if a warpage of the trenched top board and a minute off-set between dies arise during molding when the trenched top board is fabricated by a use of a molding technology. A still another object of the present invention is thereby to provide an ink-jet recording head capable either of a high quality recording or of a high speed recording.

To satisfy the purposes mentioned above, the present invention provides an ink-jet recording head, comprising:

an ejecting port which ejects an ink;

a substrate provided with an ejecting energy generating means which is used for ejecting ink droplets;

a trenched top board provided with trenches, which constitute partly a plurality of ink paths respectively connected to the ink ejecting ports, and provided with a concavity, which constitutes partly common liquid reservoirs respectively connected to the plurality of the ink paths; and an elastic member which pressurizes to fix the trenched top board onto the substrate; wherein:

the substrate and the top board are contacted so that the ejecting energy generating means and the trenches partly forming the ink paths coincide with each other to form the ink paths;

a contacting part of the trenched top board to be contacted with the substrate is composed of a contacting surface of the ink paths to be contacted with the substrate and of another contacting surface of the common liquid reservoirs to be contacted with the substrate; and the contacting surface of the common liquid reservoirs to be contacted with the substrate is inclined toward a substrate surface with respect to the contacting surface of the ink paths to be contacted with the substrate.

By constituting the present invention as mentioned above, the pressurizing force generated from the elastic member deforms aforesaid trenched top board so that the ink paths can contact with the substrate after deformation, to prohibit a spread of the ejecting pressure generated on the substrate provided with above-mentioned ejecting energy generating means toward the adjacent ink paths. Consequently, the recording head according to the present invention can prevent degradation in recording quality during recording such as the unstable ejecting speed of the ink, the staggered flying trajectories of the ink droplets and unnecessary ink ejections from the adjacent ejector nozzles except for the ejecting port, to which a recording signal requiring an ejection is applied, resulting in the turbulent printing.

DETAILED DESCRIPTION OF THE PREFERRED EMBODIMENTS

Hereinafter are detailed modes carrying out the present invention into practice with reference to the preferred embodiments. The best mode during carrying out the present invention into practice is also described corresponding to the embodiments.

Figure 1A:
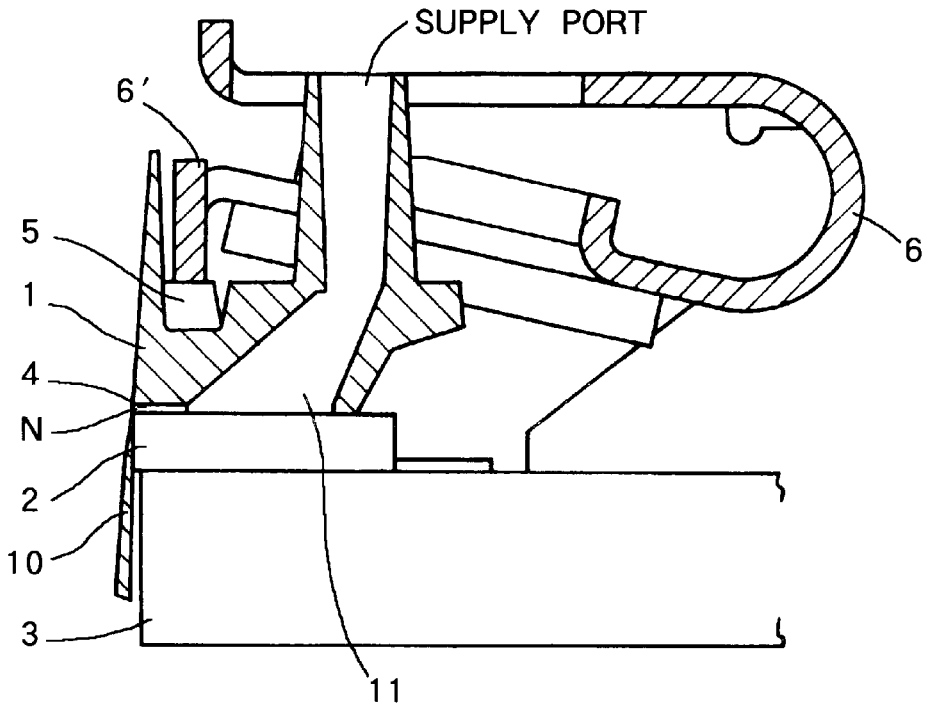
FIG. 1A is a longitudinally sectioned partial view showing main components of an ink-jet recording head according to the present invention.
Figure 1B:
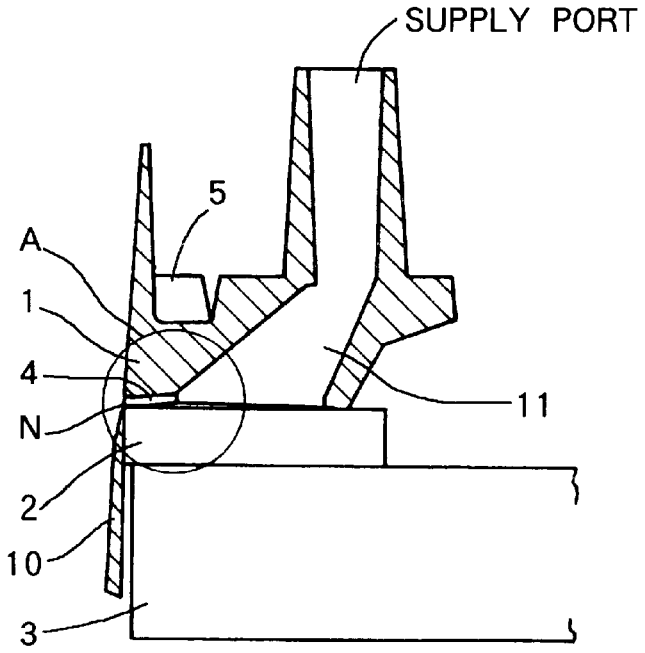
FIG. 1B is a partial view of FIG. 1A.
Figure 5:
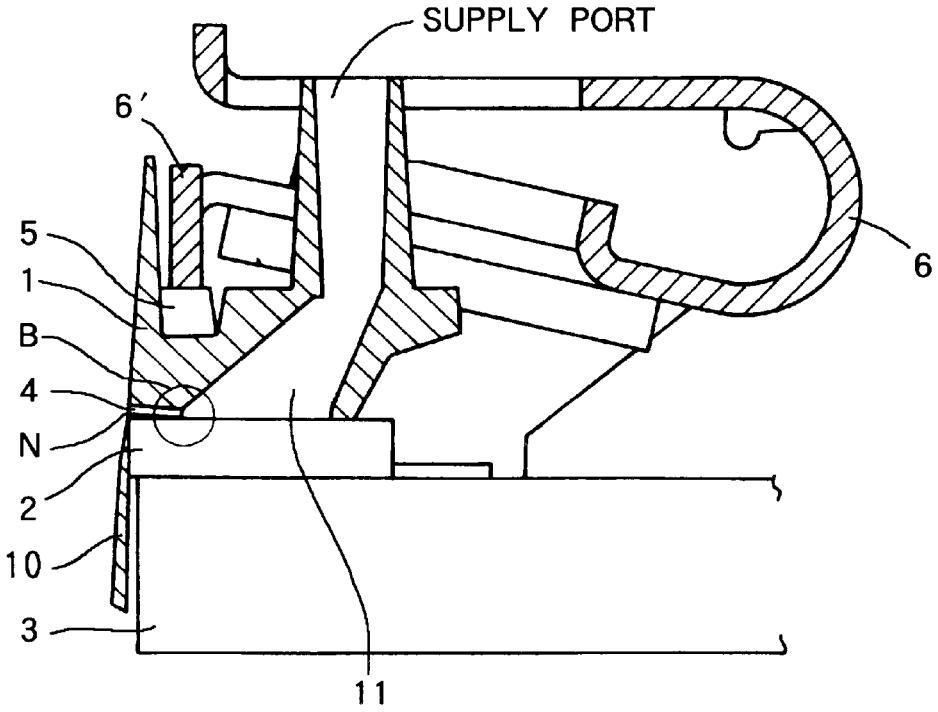
FIG.5 PRIOR ART
FIG. 5 is a longitudinally sectioned partial view showing main components of a conventional ink-jet recording head.

FIGS. 1A and 1B are the longitudinally sectioned partial views for illustrating an ink-jet recording head of the embodiment according to the present invention. In FIG. 1A, the longitudinal section view of the main components shows actually the similar components to those of the conventional recording head shown in FIG. 5. FIG. 1B is the partial view of the main components of the trenched top board shown in FIG. 1A while FIG. 2 is the enlarged view of the area enclosed with the open circle designated by an alphabetic character "A" shown in FIG. 1B.

Figure 3:
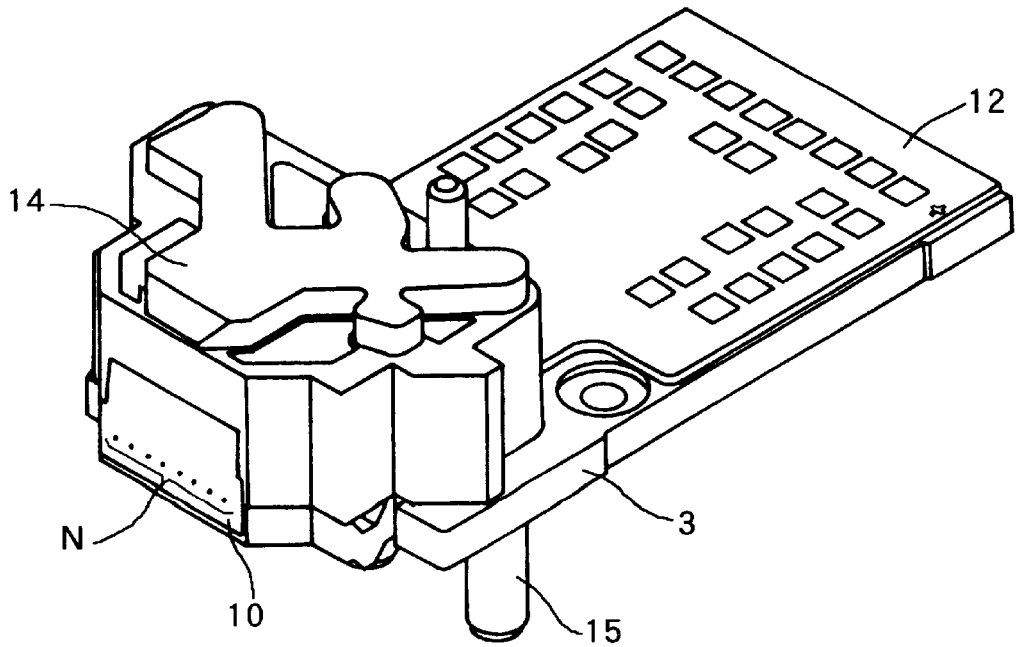
FIG. 3 is a schematic perspective view showing an embodiment of ink-jet recording heads according to the present invention.
Figure 4:
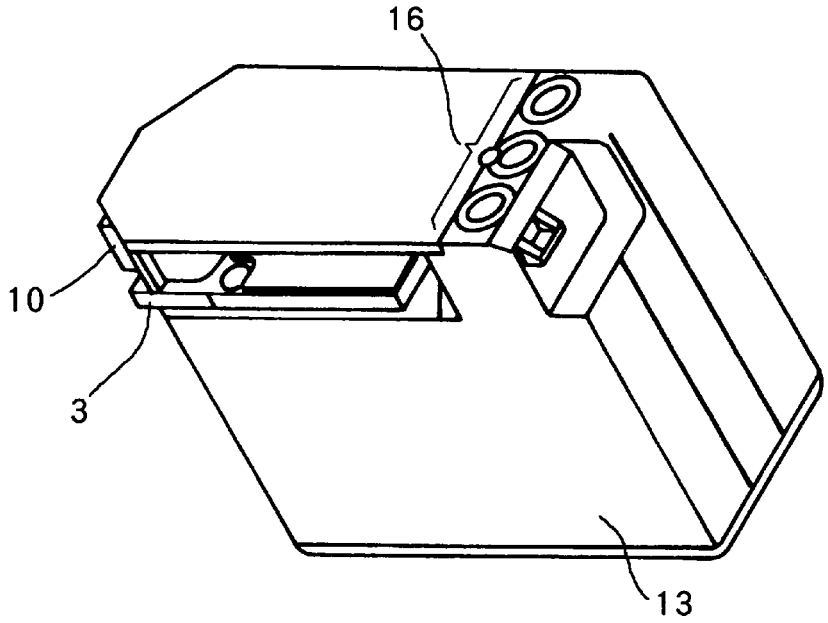
FIG. 4 is a schematic perspective view showing an embodiment of ink-jet recording cartridges according to the present invention.

On the other hand, the schematic perspective view of the ink-jet recording head according to the present invention is illustrated in FIG. 3. This is combined with an ink tank to constitute an ink-jet recording cartridge according to the present invention, of which schematic perspective view is illustrated in FIG. 4.

Figure 2:
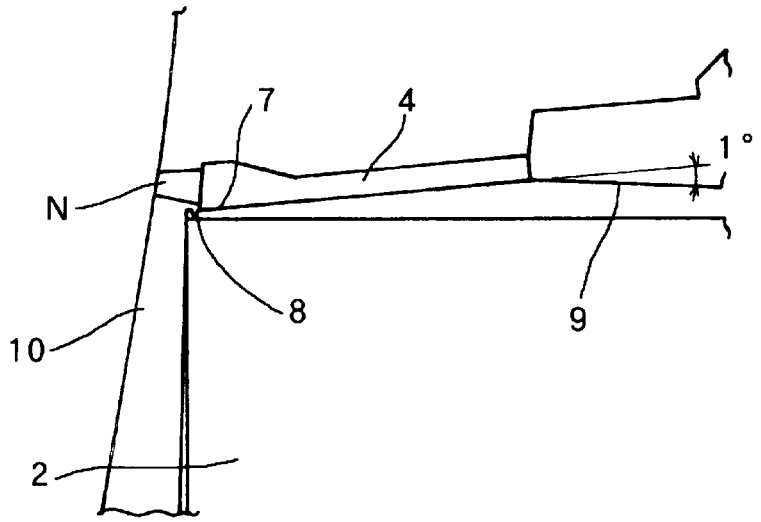
FIG. 2 is an enlarged view of an area enclosed with an open circle designated by "A" shown in FIG. 1B.

In FIGS. 1A, 1B and 2, a numeral character 1 stands for the trenched top board monolithically provided with trenches which constitute partly the ink paths 4, monolithically provided with the concavity which constitutes partly the common liquid reservoirs connected to the ink paths 4 and monolithically provided with an ejector plate 10 whereon a plurality of the ejecting ports N are formed as can be seen from FIG. 3. On the other hand, 2 stands for the substrate fixed on the base plate 3 and provided with the plurality of the heat energy generating devices (the transducers which transduce the electric energy to the heat energy in the present embodiment), which are arrayed in use for ejecting the inks.

A surface of the trenched top board 1, whereon the trenches and the concavity are formed, and another surface of the substrate 2, whereon the ejecting energy generating means are formed, are laterally aligned so that each of the ejecting energy generating means corresponds to each of the ink paths, which is then pressurized by a use of a pressurizing member such as an elastic member 6 to be fixed in a two-dimentionally aligned status. Incidentally, an end of the elastic member 6 is fixed on the base plate 3 while a pressurizing part 6' of the elastic member 6 pressurizes a part 5 to be pressurized formed on the trenched top board 1 with a line pressure in pipings applied along an ink path arraying direction, of which pressurizing force is applied mainly to the ink path area.

As shown in FIG. 3, an ink supply unit 14 provided with an ink supply tube 15, which is to be inserted into an ink tank, is formed on a supply port of the trenched top board 1. Aforesaid substrate 2 is electrically connected to a circuit board 12, which is provided with electric terminals to be electrically interconnected to the recording apparatus. The encapsulant (unshown in the figure) is further applied around the contacting part between the trenched top board 1 and the substrate 2 as well as around the electrically interconnected portions between the substrate 2 and the circuit board 12.

In FIG. 4, loading the head unit fabricated as mentioned above onto a main body 13 of an ink-jet head cartridge equipped with the ink tanks as shown in the figure provides the ink-jet cartridge. Incidentally, the ink-jet cartridge used in the present embodiment has a constitution containing three sorts of color inks: a yellow, a magenta red and a cyan blue inks. Each of the color ink tanks is provided with each of communicating tubes 16 individually exhausted to an open air.

As shown in FIG. 2, the contacting part of the trenched top board 1 to be contacted with the substrate 2 is composed of the surface 7 of the ink paths 4 contacting with the substrate 2 and the another surface 9 of the common liquid reservoirs contacting with the substrate 2, the latter surface 9 of which is inclined with respect to the former surface 7 toward the surface of the substrate 2. This inclination makes a boundary located on the trenched top board 1 between the ink paths 4 and the common liquid reservoirs 11 float from the substrate 2 during contacting the trenched top board with the substrate 2 as can be seen from FIG. 1B.

However, the pressurizing part 6' of the elastic member 6 concentrates the pressurizing force onto the ink path part of the trenched top board 1, resulting in an assured contact between the floating part of the trenched top board 1 and the substrate 2 due to an elastic deformation of the trenched top board 1 itself. The assured contacts obtained as mentioned above between the ink path part and the substrate 2 as well as between the common liquid reservoir part and the substrate 2 can provide an ink-jet recording head capable of recording in a high quality without inducing any vacancies which allow the intrusion of the encapsulant into the liquid reservoirs.

In the present embodiment, the surface 7 of the ink paths 4 contacting with the substrate 2 intersects the another surface 9 of the common liquid reservoirs contacting with the substrate 2 at an angle of one degree (referred to as 1° hereinafter). However, the inclination angle is not restricted to 1° at all. It is confirmed that the trenched top board 1 can maintain an enough adhesion to the substrate 2 so long as the intersection angle stays between 0° and 2°.

To improve further an adhesion of the ink path area in a vicinity of the energy generating means, a constitution as has been disclosed in the Japanese Laid-open Patent Application Number: 4-247946 (1992), wherein a protrusion 8 formed of such as a scratching on a die wall during transfer molding is provided on the substrate contacting surface 7 of the ink path area 4 adjacently to an ejector plate 10, may be preferable. Because the substrate contacting surface 9 of the common liquid reservoir part formed on the trenched top board 1 is inclined with respect to another substrate contacting surface 7 of the ink path area toward the substrate direction in the present embodiment, the pressurizing force is more concentrated onto the protrusion 8 during contacting the trenched top board 1 with the substrate 2 than that of the constitution disclosed in the Japanese Laid-open Patent Application Number: 4-247946 (1992). This provides a more stable adhesion than a case when merely the protrusion is formed in the vicinity of the ejector plate 10 without forming the inclination.

The ink-jet recording head manufactured mentioned above is used experimentally for printing (recording), which proves that it can provide a high quality printing without any recording quality degradation such as the staggering in flying trajectory of the ink droplets and the turbulent printing.

In each of FIGS. 1A, 1B and 2 herein, dimensions and angles are enlarged for easily understanding the present invention and, accordingly, different from those of the actual components.

Hereinafter a generalized constitution of ink-jet recording apparatus, which can load an ink-jet recording head according to the present invention in a form of an ink-jet cartridge, is described.

Figure 6:
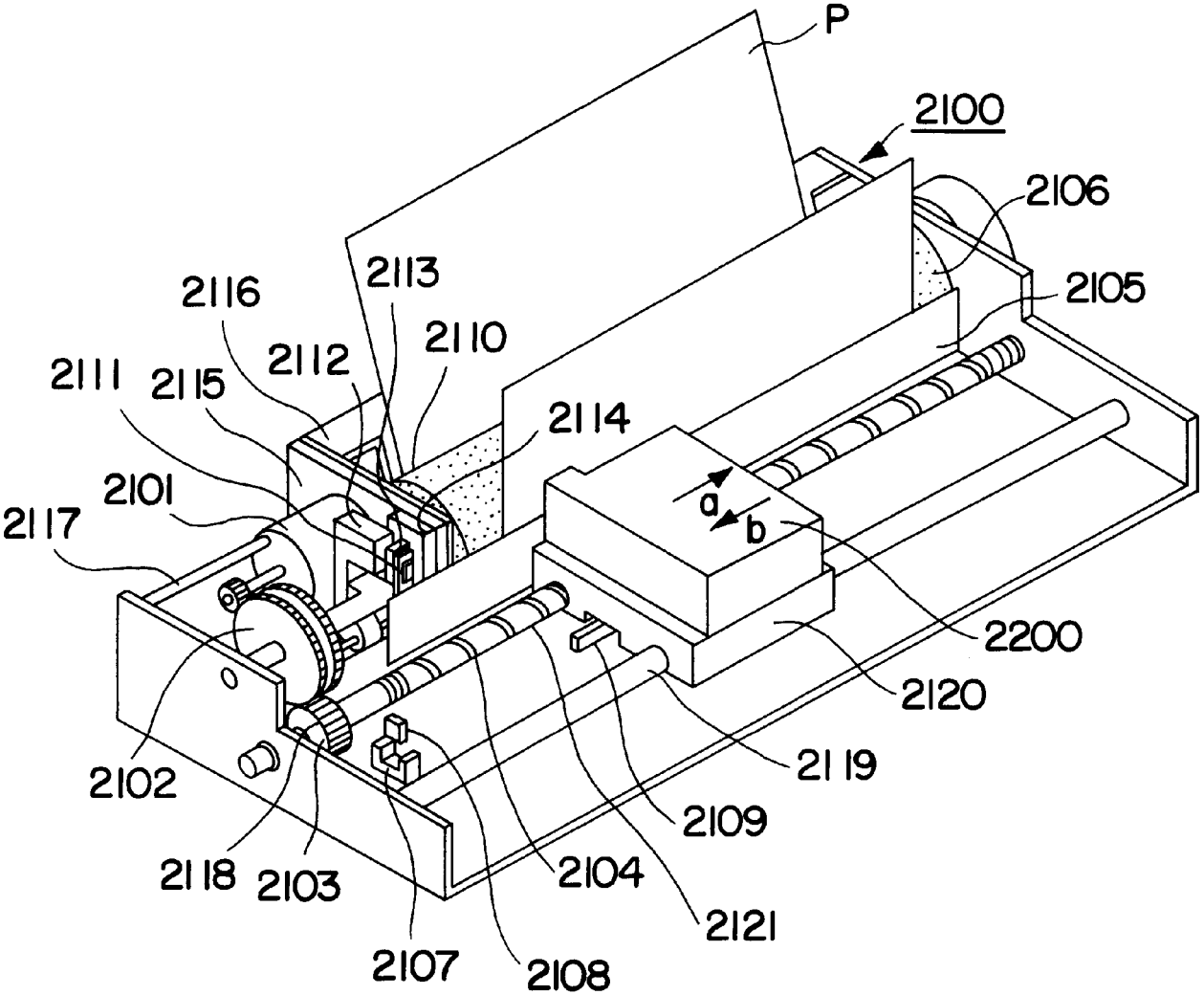
FIG. 6 is a schematic perspective view showing an example of ink-jet recording apparatus, which are capable of loading an ink-jet recording cartridge according to the present invention.

FIG. 6 is the perspective view showing the example of ink-jet recording apparatus, which are capable of loading an ink-jet recording cartridge according to the present invention. Herein an ink-jet cartridge 2200 is loaded on a carriage 2120 meshed with a spiral groove 2121 formed on a lead screw 2104, which is driven through transmission gears 2102 and 2103 for tansmitting a driving force in response to a regular and a reverse rotations of a driving motor 2101. The ink-jet cartridge 2200 is reciprocally moved along a guide 2119 together with the carriage 2120 by the driving force of aforesaid driving motor 2101 toward directions indicated by "a" and "b" shown in FIG. 6. A paper holding plate 2105 for pressing papers P in use for recording, which are supplied from a recording media supplying apparatus unshown in the figure onto a platen 2106, presses a sheet of paper P toward the platen 2106, covering a whole length that the carriage 2120 can traverse.

Numeral characters 2107 and 2108 stand for home position confirming means, wherein photo-couplers identify that a lever 2109 of the carriage 2120 is located there, to switch a rotational direction of the driving motor 2101 from one to another. A numeral character 2110 stands for a supporting member which supports a capping member 2111 for capping whole surfaces of the ink-jet cartridge 2200 while 2112 stands for an aspirating means for aspirating an inside of aforesaid capping member 2111, which serves for an aspiration recovery of the ink-jet cartridge 2200 through an opening 2113 opened inside the capping member 2111.

A numeral 2114 stands for a cleaning blade while 2115 stands for a moving means for enabling this cleaning blade 2114 to move in a back-and-forth direction. Those parts are supported on a supporting plate 2116 for supporting a main body. It is no need to say that not only cleaning blades having a similar shape to the present embodiment but also those having a well known shape are available for the cleaning blade 2144 according to the present invention.

On the other hand, 2117 stands for a lever for beginning an aspirating operation of the aspiration recovery, which is moved in response to a movement of a cam 2118 correlated to the carriage 2120 to control the driving force generated from the driving motor 2101 by use of well known transmission means such as switching a crutch. A recording control part unshown in the figure, which transmits a control signal to the heat generating means 2110 provided on aforesaid recording cartridge 2200 and serves as a driving control means of above-mentioned mechanisms, is installed on the main body of the recording apparatus 2100.

In the ink-jet recording apparatus 2100 constituted mentioned above, the ink-jet cartridge 2200 performs the recording onto aforesaid recording paper P supplied from above-mentioned recording media supplying apparatus to the platen 2106 during reciprocal motion covering the full length of the paper. The ink-jet cartridge manufactured by use of aforesaid technologies enables the high precision and the high speed recording.

Because the present invention can attain an excellent adhesion between the substrate and the whole surface of the trenched top board to be contacted with the substrate as mentioned above, the phenomenon that the ejecting pressure generated on the substrate spreads to the adjacent ink paths is prohibited. This can provide the ink-jet recording head capable of the high-quality recording and the high-speed recording without inviting the degradation in recording quality such as the instability in ejecting speed of the ink, the staggering in flying trajectories of the ink droplets and the unnecessary ink ejections from the adjacent ejecting ports except the port that the recording signal is applied to eject the ink, which generate the turbulent printing.

Furthermore, combining the above-mentioned recording head with the ink tank can provide an ink-jet recording cartridge capable of the high-quality and high-speed recording.

What is claimed is:

1. An ink-jet recording head, comprising:

an ejecting port which ejects an ink;

a substrate provided with an ejecting energy generating means which is used for ejecting ink droplets;

a trenched top board provided with trenches, which constitute partly a plurality of ink paths connected to said ink ejecting port, and provided with a concavity, which constitutes partly a common liquid reservoir connected to said plurality of said ink paths; and an elastic member which presses to fix said trenched top board onto said substrate; wherein:

said substrate and said trenched top board are contacted so that said ejecting energy generating means and said trenches partly forming said ink paths coincide with each other to form said ink paths; and a contacting portion of said trenched top board to be contacted with said substrate is composed of a first contacting surface of said ink paths to be contacted with said substrate and a second contacting surface of said common liquid reservoir to be contacted with said substrate, wherein said second contacting surface is inclined with respect to said first contacting surface, and wherein said trenched top board forms a substantially triangular shaped opening in a longitudinal direction along the direction of ink paths at a point of contact with the substrate, whereby the substrate contacts said first contacting surface at a first point and said second contacting surface at a second point.

2. The ink-jet recording head according to claim 1, wherein:

said second contacting surface is inclined with respect to said first contacting surface at an angle which is larger than 0° and smaller than 2°.

3. The ink-jet recording head according to claim 1, wherein:

an ejector plate provided with said ejecting port is monolithically formed on said trenched top board.

4. The ink-jet recording head according to claim 3, wherein:

a protrudent ridge, which is capable of being deformed by application of a pressurizing force generated from the elastic member, assembled on said trenched top board during contact with said substrate, is formed on said first contacting surface adjacent said ejector plate.

5. The ink-jet recording head according to claim 1, wherein:

said elastic member exerts pressure on an upper portion of one or more of said trenches of said trenched top board via a line pressure in a piping of tubes.

6. An ink-jet cartridge comprising:

said ink-jet recording head according to claim 1; and an ink tank connected to the ink-jet recording head for supplying ink to said ink-jet recording head.

* * * * *

UNITED STATES PATENT AND TRADEMARK OFFICE

CERTIFICATE OF CORRECTION

PATENT NO. : 6,056,393

DATED : May 2, 2000

INVENTOR(S) : YOICHI TANEYA ET AL.

It is certified that error appears in the above-identified patent and that said Letters Patent is hereby corrected as shown below:

ON THE COVER PAGE AT [57] ABSTRACT

Line 2, "dignity" should read --device--.

COLUMN 1

Line 17, "capable" should read --possible--;
Line 18, "so called a" should read --a so-called--;
Line 65, "spreaded" should read --spread--.

COLUMN 2

Line 25, "a still" should read --yet--;
Line 37, "can" should read --which can--;
Line 46, "than so far" should be deleted.

COLUMN 3

Line 3, "with" should be deleted;
Line 13, "A still" should read --Yet--.

COLUMN 4

Line 36, "which" should read --which a--.

COLUMN 5

Line 15, "inks" should be deleted;
Line 46, "an" should be deleted.

UNITED STATES PATENT AND TRADEMARK OFFICE

CERTIFICATE OF CORRECTION

PATENT NO. : 6,056,393

DATED : May 2, 2000

INVENTOR(S) : YOICHI TANEYA ET AL.

It is certified that error appears in the above-identified patent and that said Letters Patent is hereby corrected as shown below:

COLUMN 6

Line 47, "It" should read --There--;
Line 56, "switching a crutch." should read --a clutch.--;
Line 62, "men-" should read --as men--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*